US006374722B1

(12) United States Patent
Du et al.

(10) Patent No.: US 6,374,722 B1
(45) Date of Patent: Apr. 23, 2002

(54) APPARATUS AND METHOD FOR CONTROLLING A DISCHARGE PRESSURE OF A VARIABLE DISPLACEMENT HYDRAULIC PUMP

(75) Inventors: Hongliu Du, Dunlap, IL (US); Noah D. Manring, Columbia, MI (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/697,831

(22) Filed: Oct. 26, 2000

(51) Int. Cl.[7] ..... F01B 3/00; F01B 13/07

(52) U.S. Cl. ..... 91/506; 417/222.1

(58) Field of Search ..... 91/506, 374; 417/222.1, 417/218; 60/444, 455, 483, 437

(56) References Cited

U.S. PATENT DOCUMENTS

| | | | | | |
|---|---|---|---|---|---|
| 3,579,988 | A | * | 5/1971 | Firth et al. | 60/455 |
| 3,631,763 | A | * | 1/1972 | Court | 91/506 |
| 3,643,434 | A | * | 2/1972 | Wildmaier | 60/437 |
| 3,738,779 | A | | 6/1973 | Hein et al. | |
| 3,797,245 | A | | 3/1974 | Hein | |
| 3,945,764 | A | | 3/1976 | Marietta | |
| 4,013,380 | A | * | 3/1977 | Pensa | 417/218 |
| 4,028,010 | A | | 6/1977 | Hopkins | |
| 4,097,196 | A | | 6/1978 | Habiger | |
| 4,212,596 | A | | 7/1980 | Ruseff | |
| 4,483,663 | A | * | 11/1984 | Myers | 417/222.1 |
| 4,553,904 | A | | 11/1985 | Ruseff et al. | |
| 4,617,797 | A | * | 10/1986 | Williams | 60/444 |
| 4,733,601 | A | * | 3/1988 | Neirynck | 91/374 |
| 5,207,060 | A | * | 5/1993 | Sheets | 60/483 |
| 5,222,870 | A | | 6/1993 | Budzich | |
| 5,567,123 | A | * | 10/1996 | Childress et al. | 417/222.1 |
| 5,697,764 | A | | 12/1997 | Oda et al. | |

* cited by examiner

*Primary Examiner*—Teresa Walberg
*Assistant Examiner*—Leonid M Fastovsky
(74) *Attorney, Agent, or Firm*—Steve D. Lundquist

(57) ABSTRACT

An apparatus and method for controlling a discharge pressure of a variable displacement hydraulic pump. The apparatus and method includes a swashplate pivotally attached to the pump, a valve plate located on the pump to allow hydraulic fluid to enter the pump through an intake port on the valve plate, and to exit the pump through a discharge port on the valve plate, the hydraulic fluid entering and exiting the pump responsively creating a pressure carry over angle γ, a control servo operable to control an angle of the swashplate relative to the pump, a servo valve having an output port hydraulically connected to the control servo and an input port hydraulically connected to the pump output port, and means for controlling the servo valve as a function of the discharge pressure of the pump and responsively balancing a torque induced by the pressure carry over angle γ with a torque generated by a control pressure $P_c$ at the control servo.

14 Claims, 4 Drawing Sheets

APPARATUS AND METHOD FOR CONTROLLING A DISCHARGE PRESSURE OF A VARIABLE DISPLACEMENT HYDRAULIC PUMP

TECHNICAL FIELD

This invention relates generally to an apparatus and method for controlling a variable displacement hydraulic pump and, more particularly, to an apparatus and method for controlling variations in pump discharge pressure caused by load variations.

BACKGROUND ART

Variable displacement hydraulic pumps, such as axial piston variable displacement pumps, are widely used in hydraulic systems to provide pressurized hydraulic fluid for various applications. For example, hydraulic earthworking and construction machines, e.g., excavators, dozers, loaders, and the like, rely heavily on hydraulic systems to operate, and hence often use variable displacement hydraulic pumps to provide the needed pressurized fluid.

These pumps are driven by a constant speed mechanical shaft, for example by an engine, and the discharge flow rate, and hence pressure, is regulated by controlling the angle of a swashplate pivotally mounted to the pump.

Ideally, it is desired to maintain a desired output pressure, i.e., the pump discharge pressure, for a given swashplate angle. However, variations in loading on the hydraulic system may require the pump discharge pressure to be varied as well, which in turn requires changes to be made to the angle of the swashplate. These changes, in conventional pump control systems, often result in overshoot, i.e., pressure spikes. Thus, relief valves must be used to prevent these pressure spikes from damaging the pump or hydraulic system.

In many conventional design pump systems, the pump discharge pressure is fed back to a biasing servo, which is configured to increase the swashplate angle as the pump discharge pressure increases. The increased swashplate angle further increases the pump discharge pressure, thus leading to an unstable open loop condition of the pump.

It is desired to develop a control system for a variable displacement pump which utilizes the benefits and simplicity of a linear first order dynamic system which eliminates overshoot, thus eliminating the need for relief valves. To accomplish this, it is also desired to configure the variable displacement pump so that the open loop system is internally stable.

The present invention is directed to overcoming one or more of the problems as set forth above.

DISCLOSURE OF THE INVENTION

In one aspect of the present invention an apparatus for controlling a discharge pressure of a variable displacement hydraulic pump is disclosed. The apparatus includes a swashplate pivotally attached to the pump, a valve plate located on the pump to allow hydraulic fluid to enter the pump through an intake port on the valve plate, and to exit the pump through a discharge port on the valve plate, the hydraulic fluid entering and exiting the pump responsively creating a pressure carry over angle $\gamma$, a control servo operable to control an angle of the swashplate relative to the pump, a servo valve having an output port hydraulically connected to the control servo and an input port hydraulically connected to the pump output port, and means for controlling the servo valve as a function of the discharge pressure of the pump and responsively balancing a torque induced by the pressure carry over angle $\gamma$ with a torque generated by a control pressure $P_c$ at the control servo.

In another aspect of the present invention a method for controlling a discharge pressure of a variable displacement hydraulic pump is disclosed. The method includes the steps of sensing a level of the discharge pressure at the pump output port, diverting a portion of the pump discharge pressure to a servo valve, delivering a control signal to the servo valve as a function of the sensed level of discharge pressure, and delivering a responsive hydraulic control flow from the servo valve to a control servo, the control servo being operable to control an angle of the swashplate, the hydraulic control flow from the servo valve providing a control pressure $P_c$ at the control servo operable to balance a torque induced by a pressure carry over angle $\gamma$ of a valve plate located on the pump.

BEST MODE FOR CARRYING OUT THE INVENTION

Figure 1:
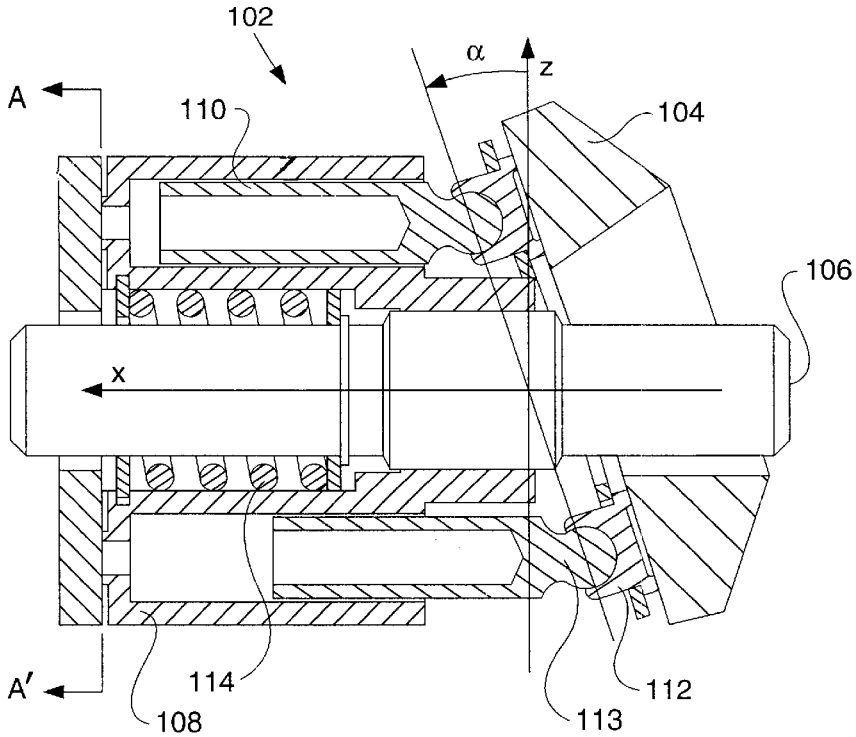
FIG. 1 is a diagrammatic side profile cutaway view of a variable displacement hydraulic pump suitable for use with the present invention.

Referring to the drawings, an apparatus 100 and method for controlling a discharge pressure of a variable displacement hydraulic pump 102 is disclosed.

Figure 2:
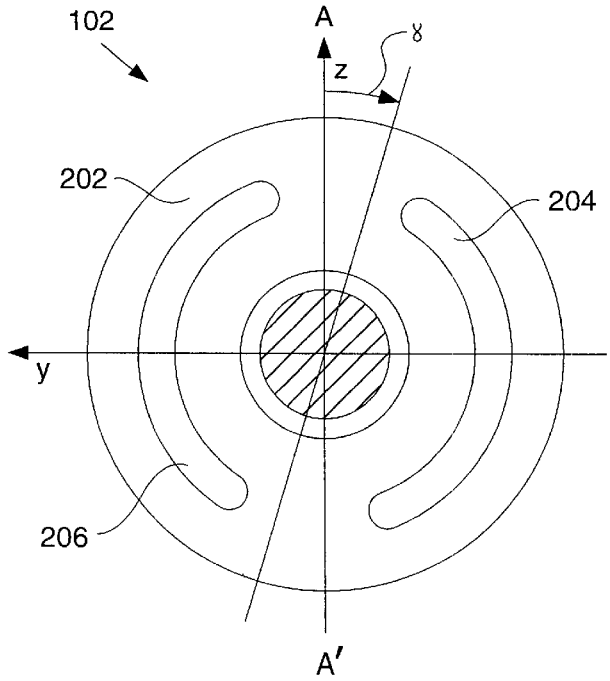
FIG. 2 is a diagrammatic end view of the pump of FIG. 1.

With particular reference to FIGS. 1 and 2, the variable displacement hydraulic pump 102, hereinafter referred to as pump 102, is preferably an axial piston swashplate hydraulic pump 102 having a plurality of pistons 110, e.g., nine, located in a circular array within a cylinder block 108. Preferably, the pistons 110 are spaced at equal intervals about a shaft 106, located at a longitudinal center axis of the block 108. The cylinder block 108 is compressed tightly against a valve plate 202 by means of a cylinder block spring 114. The valve plate includes an intake port 204 and a discharge port 206.

Each piston 110 is connected to a slipper 112, preferably by means of a ball and socket joint 113. Each slipper 112 is maintained in contact with a swashplate 104. The swashplate 104 is inclinably mounted to the pump 102, the angle of inclination a being controllably adjustable.

Figure 3:
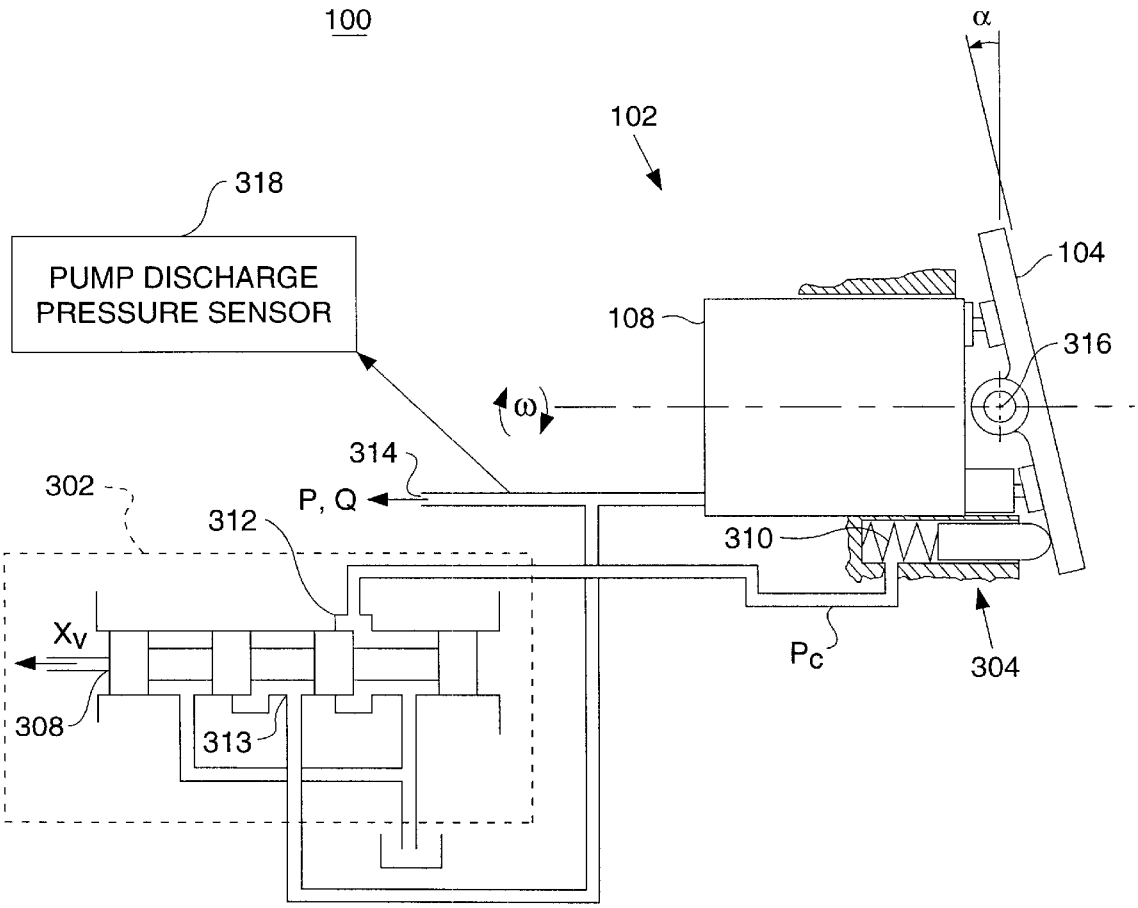
FIG. 3 is a diagrammatic illustration of a pump including a servo valve.

With continued reference to FIGS. 1 and 2, and with reference to FIG. 3, operation of the pump 102 is illustrated. The cylinder block 108 rotates at a constant angular velocity $\omega$. As a result, each piston 110 periodically passes over each of the intake and discharge ports 204,206 of the valve plate 202. The angle of inclination $\alpha$ of the swashplate 104 causes the pistons 110 to undergo an oscillatory displacement in and out of the cylinder block 108, thus drawing hydraulic fluid into the intake port 204, which is a low pressure port, and out of the discharge port 206, which is a high pressure port. The hydraulic fluid entering and exiting the pump 102 between the low pressure intake port 204 and the high pressure discharge port 206 causes a pressure differential which creates a swashplate pressure carry over angle γ. The pressure carry over angle γ induces a torque on the swashplate 104, as described below with reference to FIGS. 5*a* and 5*b*, which is opposed to the force applied by the control servo 304.

In the preferred embodiment, the angle of inclination α of the swashplate 104 inclines about a swashplate pivot point 316 and is controlled by a servo valve 302. A servo valve spool 308 is controllably moved in position within the servo valve 302 to control hydraulic fluid flow at an output port 312 of the servo valve 302. In the preferred embodiment, the servo valve 302 is an electro-hydraulic valve, and is thus controlled by an electrical signal being delivered to the valve 302. A control servo 304, in cooperation with a servo spring 310, receives pressurized fluid from the output port 312 of the servo valve 302, and responsively operates to increase the angle of inclination α of the swashplate 104, thus increasing the stroke of the pump 102. The pump 102 provides pressurized hydraulic fluid to the discharge port 206 of the valve plate 202 by means of a pump output port 314. Preferably, a portion of the hydraulic fluid from the pump output port 314 is diverted to a servo valve input port 313 to provide feedback control for the present invention, as discussed below with reference to FIG. 4.

A pump discharge pressure sensor 318, preferably located at the pump output port 314, is adapted to sense the output pressure of the hydraulic fluid from the pump 102. Alternatively, the pump output pressure sensor 318 may be located at any position suitable for sensing the pressure of the fluid from the pump 102, such as at the discharge port 206 of the valve plate 202, at a point along the hydraulic fluid line from the pump 102 to the hydraulic system being supplied with pressurized fluid, and the like. In the preferred embodiment, the pump discharge pressure sensor 318 is of a type well known in the art and suited for sensing pressure of hydraulic fluid.

Figure 4:
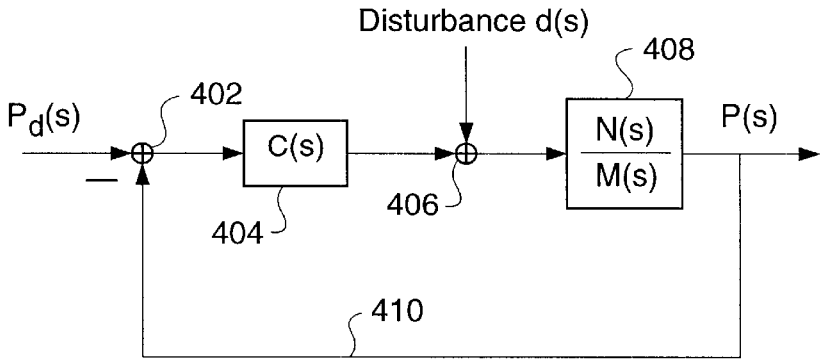
FIG. 4 is a control diagram illustrating a preferred embodiment of the present invention.

With reference to FIG. 4, if higher bandwidth dynamics, such as dynamics of the servo valve, are neglected, an open loop system of the configuration of FIG. 3 can be expressed as:

$$P(s) = \frac{-(b_q(a_1C_{lc} + a_c^2)s + b_q)Q(s) + c_x a_c b_0 x_v(s)}{(a_1C_{lc} + a_c^2)s^2 + ((a_1C_{lc} + a_c^2)b_p + a_0C_{lc})s + (a_0C_{lc}b_p + a_pC_{lc}b_0)} \quad \text{(Eq. 1)}$$

where P is the pump discharge pressure, Q is the discharge flow rate, $x_v$ represents the position of the servo valve spool 308, $C_{1c}$ is a leakage coefficient of the control servo 304, and the various $a_x$, $b_x$, and $c_x$ terms relate to various physical and geometric parameters of the pump 102, servo valve, 302, control servo 304, and interconnecting hoses and lines. With all the coefficients being strictly positive, the open loop system expressed in Eq. 1 is strictly stable.

Letting $$N(s)=c_x a_c b_0 \quad \text{(Eq. 2)}$$

and $$M(s)=(a_1C_{lc}+a_c^2)s^2+((a_1C_{lc}+a_c^2)b_p+a_0C_{lc})s+(a_0C_{lc}b_p+a_pC_{lc}b_0) \quad \text{(Eq. 3),}$$

the closed loop transfer function T can be written as:

$$T(s) = \frac{C(s)N(s)}{M(s) + C(s)N(s)}. \quad \text{(Eq. 4)}$$

In FIG. 4, a first summer 402 receives the desired pump discharge pressure $P_d$ and the actual pump discharge pressure P by way of a feedback loop 410. The resultant summed signal is then delivered to a fist gain block 404, where the controller C is applied. The signal is then delivered to a second summer 406, where a Disturbance function is introduced. Preferably, the Disturbance function includes flow disturbance dynamics, which result from variations in the flow rate of the hydraulic fluid during normal operation. The signal is then delivered to a second gain block 408, where the function N/M is applied.

In the preferred embodiment, controller C is a PD controller of the form:

$$C(s)=k_d s+k_p \quad \text{(Eq. 5)}$$

The transfer function T is essentially a first order dynamic system, thus implying that no overshoot for a step response can be expected.

Figure 6:
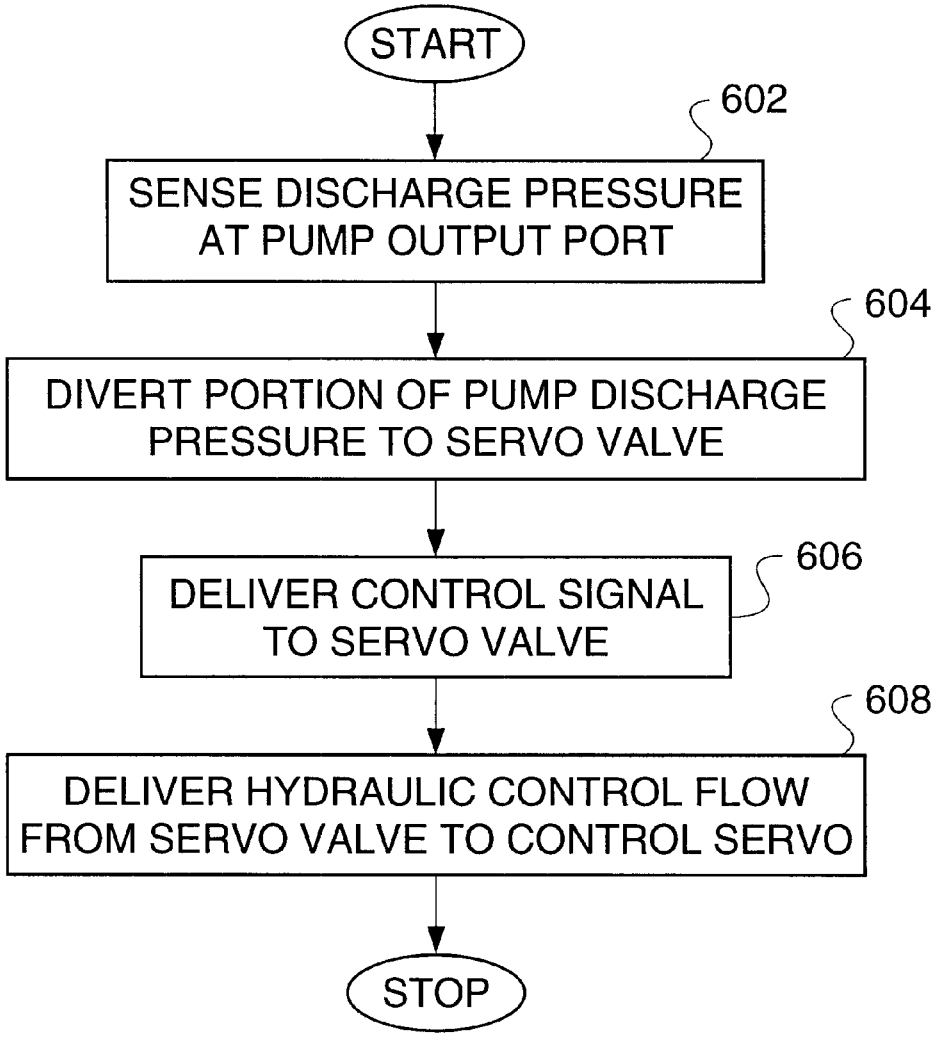
FIG. 6 is a flow diagram illustrating a preferred method of the present invention.

Referring to FIG. 6, a flow diagram illustrating a preferred method of the present invention is shown.

In a first control block 602, the pump discharge pressure is sensed, preferably by a pump discharge pressure sensor 318 located at the pump output port 314.

In a second control block 604, a portion of the pump discharge pressure is diverted from the pump output port 314 to the servo valve input port 313.

In a third control block 606, a control signal is delivered to the servo valve 302 as a function of the sensed level of pump discharge pressure.

In a fourth control block 608, in response to the control signal being delivered to the servo valve 302, a hydraulic control flow is delivered from the servo valve 302 by way of the servo valve output port 312 to the control servo 304. The control servo then responds by controlling an angle α of the swashplate 104 relative to the pump 102. In addition, the hydraulic control flow from the servo valve 302 provides a control pressure $P_c$ at the control servo 304 which is operable to balance the torque induced by the pressure carry over angle γ of the valve plate 202. This balancing of the torque caused by the pressure carry over angle γ eliminates the need for a second servo at the other end of the swashplate 104, as is normally found in prior variable displacement hydraulic pumps.

INDUSTRIAL APPLICABILITY

Figure 5A:
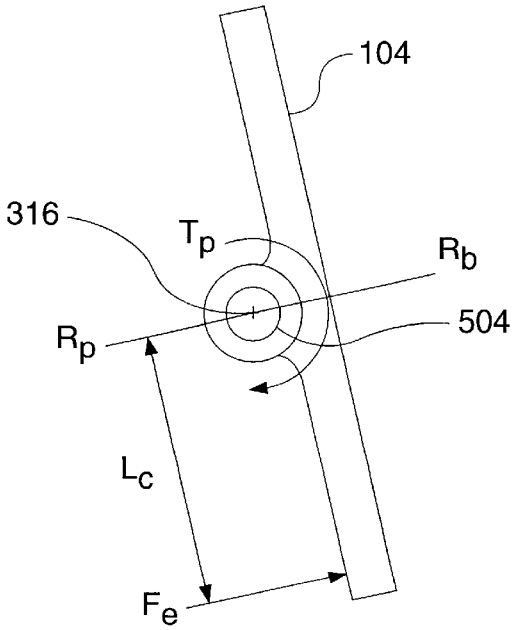
FIG. 5*a* is a diagrammatic illustration of a first aspect of forces applied to a swashplate.
Figure 5B:
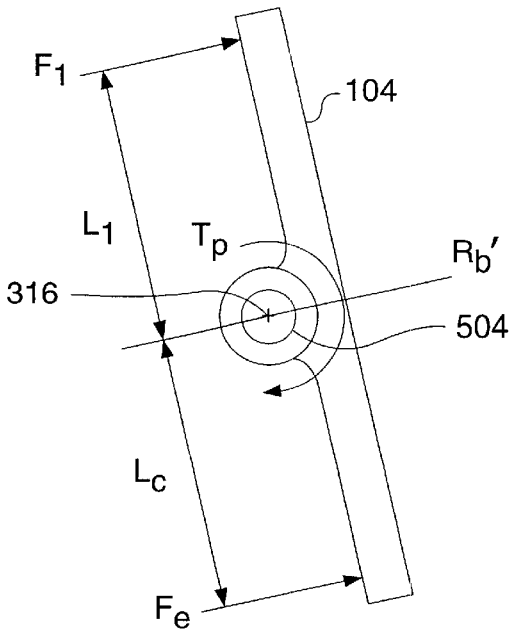
FIG. 5*b* is a diagrammatic illustration of a second aspect of forces applied to a swashplate.

As an example of some of the advantages of the present invention, reference is made to FIGS. 5*a* and 5*b*. FIG. 5*a* illustrates the forces and torques applied to a swashplate 104 having only one servo, i.e., the control servo 304 of the present invention. FIG. 5*b*, on the other hand, illustrates the forces and torques applied to a swashplate 104 having two servos, i.e., as found in previously disclosed pumps. The forces are analyzed at the location of a set of swashplate bearings 504, located at the swashplate pivot point 316. In FIGS. 5*a* and 5*b*, $T_p$ represents the flow torque induced by the pressure carry over angle γ, and $R_p$ represents the pressure force caused by the pump discharge pressure P.

It has been found that a bearing reaction force $R_b$ in FIG. 5*a* is much smaller than a corresponding bearing reaction force $R_b'$ in FIG. 5*b*, as expressed by the equation:

$$R_b = R'_b - A_1 P\left(1 + \frac{L_1}{L_c}\right) \quad \text{(Eq. 6)}$$

where $A_1$ is the cross section area of the eliminated servo, $L_1$ is the distance from the swashplate pivot point 316 to the eliminated servo, and $L_c$ is the distance from the swashplate pivot point 316 to the control servo 304.

The present invention offers the advantages of decreasing the forces exerted on the swashplate bearings 504, reducing the cost of manufacturing the pumps (since fewer, reduced size parts are needed), and creating a more stable system with the elimination of overshoot caused by load variations. Other aspects, objects, and features of the present invention can be obtained from a study of the drawings, the disclosure, and the appended claims.

We claim:

1. An apparatus for controlling a discharge pressure of a variable displacement hydraulic pump, the discharge pressure being located at a pump output port, comprising:

a swashplate pivotally attached to the pump;

a valve plate located on the pump to allow hydraulic fluid to enter the pump through an intake port on the valve plate, and to exit the pump through a discharge port on the valve plate, the hydraulic fluid entering and exiting the pump responsively creating a pressure carry over angle $\gamma$;

a control servo operable to control an angle of the swashplate relative to the pump;

a servo valve having an output port hydraulically connected to the control servo and an input port hydraulically connected to the pump output port; and means for controlling the servo valve as a function of the discharge pressure of the pump and responsively balancing a torque induced by the pressure carry over angle $\gamma$ with a torque generated by a control pressure $P_c$ at the control servo.

2. An apparatus, as set forth in claim 1, wherein the hydraulic fluid at the intake port on the valve plate is a low pressure fluid, the hydraulic fluid at the discharge port on the valve plate is a high pressure fluid, and the pressure carry over angle $\gamma$ is created by a pressure difference between the hydraulic fluids at the intake and discharge ports.

3. An apparatus, as set forth in claim 1, wherein the control servo is operable to increase the angle of the swashplate relative to the pump in response to an increase in hydraulic pressure from the servo valve to the control servo.

4. An apparatus, as set forth in claim 1, wherein the control servo includes a servo spring to maintain a spring force on the swashplate.

5. An apparatus, as set forth in claim 4, wherein the servo valve is adapted to provide the control pressure $P_c$ to the control servo, and the control servo is responsively adapted to provide a force operable to increase the angle of the swashplate.

6. An apparatus, as set forth in claim 1, wherein the swashplate is adapted to increase the pump discharge pressure in response to an increase in the angle of the swashplate relative to the pump, and to decrease the pump discharge pressure in response to a decrease in the angle of the swashplate.

7. An apparatus, as set forth in claim 1, wherein the servo valve is an electro-hydraulic servo valve.

8. An apparatus, as set forth in claim 7, wherein the means for controlling the servo valve includes a controller adapted to control an electrical signal applied to the servo valve.

9. An apparatus, as set forth in claim 8, wherein the controller is a PD controller.

10. An apparatus, as set forth in claim 1, further including a pump discharge pressure sensor connected to the pump output port.

11. A method for controlling a discharge pressure of a variable displacement hydraulic pump, the discharge pressure being located at a pump output port, including the steps of:

sensing a level of the discharge pressure at the pump output port;

diverting a portion of the pump discharge pressure to a servo valve;

delivering a control signal to the servo valve as a function of the sensed level of discharge pressure; and delivering a responsive hydraulic control flow from the servo valve to a control servo, the control servo being operable to control an angle of the swashplate, the hydraulic control flow from the servo valve providing a control pressure $P_c$ at the control servo operable to balance a torque induced by a pressure carry over angle $\gamma$ of a valve plate located on the pump.

12. A method, as set forth in claim 11, wherein the servo valve is an electro-hydraulic servo valve, and wherein delivering a control signal to the servo valve includes the step of delivering an electrical control signal to the servo valve.

13. A method, as set forth in claim 12, wherein delivering a control signal includes the step of determining the control signal by a PD controller.

14. An apparatus for controlling a discharge pressure of a variable displacement hydraulic pump, the discharge pressure being located at a pump output port, comprising:

means for sensing a level of the discharge pressure at the pump output port;

means for diverting a portion of the pump discharge pressure to a servo valve;

means for delivering a control signal to the servo valve as a function of the sensed level of discharge pressure; and means for delivering a responsive hydraulic control flow from the servo valve to a control servo, the control servo being operable to control an angle of the swashplate, the hydraulic control flow from the servo valve providing a control pressure $P_c$ at the control servo operable to balance a torque induced by a pressure carry over angle $\gamma$ of a valve plate located on the pump.

* * * * *